United States Patent [19]

Hanes

[11] 3,932,967

[45] Jan. 20, 1976

[54] SHARPENER FOR ROTARY ELECTRIC RAZOR

[76] Inventor: Donald M. Hanes, 1755 Oakwoods, New Brighton, Minn. 55112

[22] Filed: May 7, 1975

[21] Appl. No.: 575,382

[52] U.S. Cl. ..... 51/358; 30/35; 51/150; 51/394; 51/407

[51] Int. Cl.[2] ..... B24D 17/00; B26B 19/38; B24D 11/00

[58] Field of Search ..... 51/155, 173, 358, 359, 51/394–397, 150, 401–407; 30/35; 132/75.6

[56] References Cited

UNITED STATES PATENTS 2,953,851 9/1960 Wheeler ..... 30/35

FOREIGN PATENTS OR APPLICATIONS 909,027 10/1962 United Kingdom ..... 30/35

*Primary Examiner*—Othell M. Simpson

*Attorney, Agent, or Firm*—James R. Haller; H. Dale Palmatier

[57] ABSTRACT

A rotary action electric razor which has a blade with heads rotating in an annular, slotted comb, is sharpened by inserting between the blade heads and comb a flat, annular, flexible disc having a sharpening abrasive surface and having a tab extending generally normal to the plane of the disc and away from the slots in the comb.

8 Claims, 7 Drawing Figures

SHARPENER FOR ROTARY ELECTRIC RAZOR

BACKGROUND OF THE INVENTION

The present invention relates to sharpeners for electric razors and particularly rotary-type electric razors having a blade with a plurality of blade heads which are driven about an axis, and a comb having an annular trough with a slotted, flat bottom and within which the blade heads rotate. Electric razors of this type have become increasingly popular in recent years. When such razors are used in shaving on a daily basis, the blade heads and cooperating comb eventually become dull. When this occurs, it becomes difficult to obtain a close shave, and shaving time and discomfort accordingly increase.

It would be desirable to provide a sharpener and sharpening process which could be employed by the users of rotary electric shavers to sharpen the blade heads and comb. U.S. Pat. No. 2,953,851 shows a sharpening device formed from a rigid ring of an abrasive, non-resilient material such as cast oil stone and a second ring of resilient material such as rubber. The device is to be inserted between the blade heads and comb of a rotary-type electric shaver, and sharpens either the blade heads or the comb depending upon whether the rigid, abrasive ring faces the blade heads or the comb. Rigid material such as oil stone and the like are notoriously brittle, however, and the likelihood of breakage of this device is accordingly great. Moreover, it is apparent that devices of this type must be very carefully, and hence expensively, manufactured in order to correctly align the oil stone and rubber rings, maintain proper dimensions, and avoid breakage. Further, there is no way of easily removing the device from the comb. It is likely that tapping the comb upon a hard surface to dislodge the device would contribute to breakage of the device. In addition, should the rigid abrasive ring become grooved by contact with, for example, a misshapen blade head it would be difficult to resurface the abrasive ring.

A simple and inexpensive sharpener for rotary razors, which is not subject to breakage and which can be easily removed from the comb of a rotary razor by the user is much to be desired.

BRIEF DESCRIPTION OF THE INVENTION

The present invention provides a simple, inexpensive sharpener for rotary action electric razors having blades rotating in an annular, slotted comb. The sharpener comprises a flat, annular, flexible disc fitting within the comb and having a sharpening abrasive surface. The disc includes a tab extending from its edge and positionable at an angle to the plane of the disc. Depending upon whether the tab extends from the inner or the outer peripheral surface of the disc, the tab contacts the rotary blade of the razor or the outer peripheral surface of the comb. The thickness of the tab is desirably at least half the thickness of the disc, and a plurality of tabs may be employed if desired. Both flat surfaces of the disc preferably are abrasive so that the disc may be reversed and reused.

BRIEF DESCRIPTION OF THE PREFERRED EMBODIMENT

Figure 7:
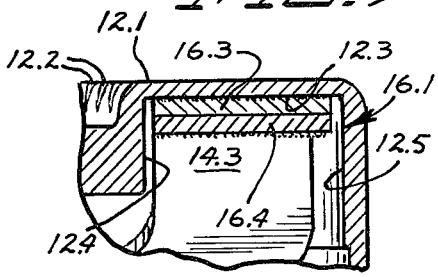
FIG. 7 is an enlarged, broken away cross-sectional view taken along line 7—7 of FIG. 1.

With reference to the drawing, the head of a rotary action razor is designated generally as 10 and includes an annular comb 12 and a multi-headed blade 14. The blade has a generally circular center disc 14.1 from the outer periphery of which radiate, at equal distances from one another, a series of arms 14.2. Each arm, as it extends outwardly from the disc 14.1, curves upwardly gently and terminates in a sharpened blade head 14.3. The disc portion 14.1 of the blade has a central hole 14.4 in which may be seated the rotating drive shaft (not shown) of an electric razor. The comb 12 has an annular, flat-bottomed trough 12.1. A series of hair-receiving slots 12.2 are formed through the thickness of the bottom of the trough 12.1, as shown best in FIGS. 1, 5 and 7. The inner surface 12.3 of the flat-bottomed trough is flat so that the flat-ended heads 14.3 of the blade can ride on the slotted surface and perform the hair-cutting operation. The walls on either side of the slotted surface 12.3 are substantially normal to the latter surface and have confronting surfaces 12.4, 12.5 (FIG. 7). Razors of this type are sold under the trademark "Norelco" by the North America Philips Corporation.

Figure 1:
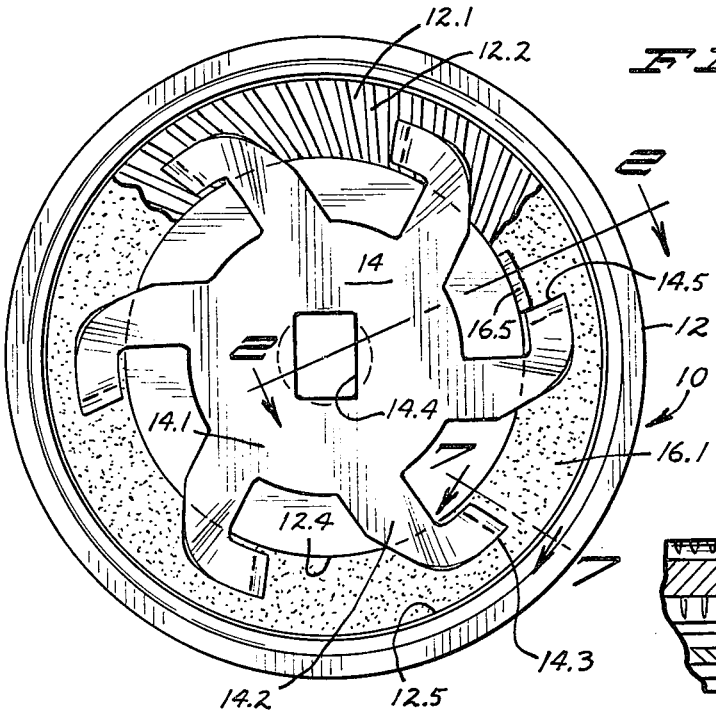
FIG. 1 is a top view of the blade and comb of a rotary action razor, showing the disc of the invention (partially broken away) in position for sharpening the comb.
Figure 5:
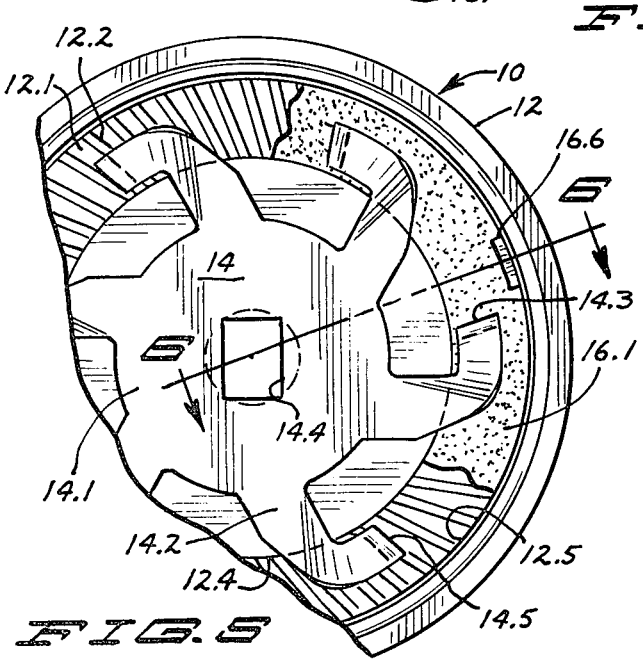
FIG. 5 is a partially broken away top view of the blade and comb of a rotary action razor with the sharpener of the invention in place for sharpening the heads of the blade.

As shown best in FIGS. 1, 5 and 7, I have found that the blade heads 14.3 are normally spaced more closely to the inner surface 12.4 than to the outer surface 12.5 of the walls forming the side of the trough, and the width of the blades 14.3 is considerably narrower than the width of the trough 12.1. For example, the width of the blades may be about 1 mm. whereas the width of the trough may be on the order of 2 mm.

Figure 3:
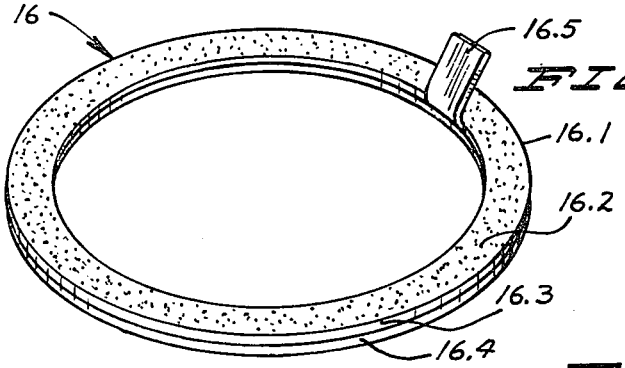
FIG. 3 is a perspective view of a sharpener of the invention.
Figure 4:
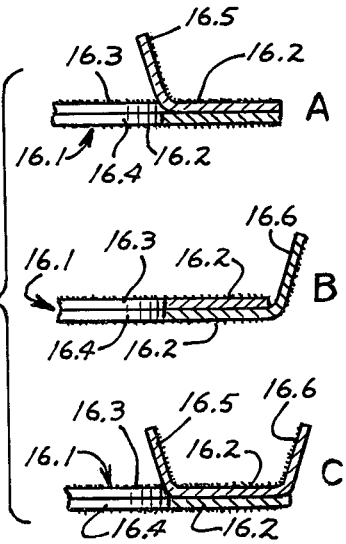
FIGS. 4 A, B and C are broken away, cross-sectional views of various sharpeners of the invention.
Figure 6:
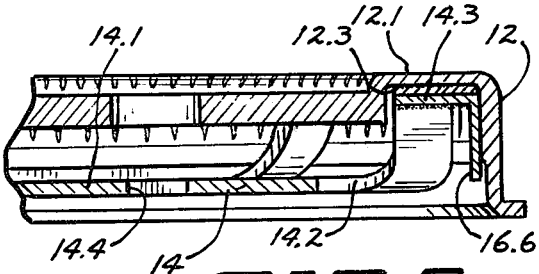
FIG. 6 is a broken away cross-sectional view taken along line 6—6 of FIG. 5.

The sharpener of the invention 16 is best depicted in FIGS. 3, 4 and 7 and comprises an annular disc 16.1 having an abrasive on at least one side to provide a flat abrasive surface 16.2. As shown in the drawing, the disc 16.1 may be made of two thicknesses 16.3, 16.4 of emery paper with the non-abrasive surfaces of the emery paper being adhered together with a thin layer of a suitable adhesive. It is desired that both flat surfaces of the disc be of abrasive material. In the embodiment of FIGS. 3 and 4A, a tab 16.5 extends from the inner periphery of the disc. The tab may be formed as an integral portion of the disc 16.1 and may then be bent up as shown in FIG. 3 from the plane of the disc to extend substantially normal from the plane. If the disc is of two thicknesses of material, as shown in the drawing, then it is desired that the tab 16.5 be formed in only one of the thicknesses 16.3. The tab 16.5 extending from the inner periphery of the disc is preferably an extension of the nearest disc layer 16.3. FIGS. 4B, 5 and 6 show a tab 16.6 arising from the outer periphery of the disc 16.1. In this embodiment, it is desired that the tab extend from the more remote layer 16.4 of the disc. FIG. 4C shows tabs extending from both the inner and outer peripheries of the disc. The tabs need not have abrasive surfaces.

The width of the disc 16.1 should be such so as to enable it to fit reasonably loosely into the flat-bottomed trough 12.1 of the comb. For example, for the razor referred to above in which the width of the trough 12.1 is approximately 2mm., the width of the disc may be approximately 1.5 mm. The resulting clearance or space between the edges of the disc and the confronting walls 12.4, 12.5 of the trough is illustrated best in FIG. 7. The thickness of the disc may be varied, and will depend to some extent on the degree to which the blade heads 14.3 have been worn down through use. I have found that a disc thickness of from about 0.15 to about 0.35 mm. yields acceptable results, with discs having a thickness of approximately 0.3 mm. being preferred. The discs must be thin enough to remain flexible, but must be thick enough to make contact with both the blade heads 14.3 and the inner surface 12.3 of the flat trough in the comb when the razor is assembled. The drive shafts (not shown) of rotary action razors generally are axially spring loaded to normally maintain some small pressure between the blade heads and the trough. I have found that 600 grit silicon carbide emery paper (sold under the trademark "TRI-M-ITE" by the Minnesota Mining and Manufacturing Company) yields good results.

The width of the tab 16.5, 16.6 may be varied but desirably is approximately the same as that of the disc 16.1. The tab 16.5 extending from the inner periphery of the disc need only extend upwardly from the plane of the disc a short distance, e.g., 1.0 mm., but may be longer for use as a "handle". The tab 16.6 extending from the outer periphery of the disc, on the other hand, preferably is somewhat longer and may be in the range of 3 mm. in length. With reference to FIG. 4B, it will be noted that since the tab 16.6 extends from the more remote disc layer 16.4, the disc has slightly greater width at the location of the tab. On the other hand, the tab 16.5, which arises from the nearer disc portion 16.3, does not add significantly to the width of the disc. It will be understood, of course, that the width of the disc in the vicinity of the tabs 16.5, 16.6 may be varied at will during their manufacture.

The sharpening discs of the invention may be prepared by adhering the smooth surfaces of sheets of emery paper together with a thin adhesive layer, and then punching or otherwise cutting the discs to proper shape from the double thickness material. If desired, the disc 16.1 may be made from a single thickness of material and may have only a single abrasive, flat surface. The tabs, initially lying in the plane of the disc, may be manually bent up as shown in FIGS. 3 and 4 when the discs are readied for a sharpening operation.

In sharpening a rotary action razor with the sharpener of the invention, separate operations are used to smoothen and sharpen the comb and to sharpen the blade heads. It is immaterial which part of the razor is sharpened first; I prefer, however, to first sharpen the comb. A disc having a tab 16.5 arising from its inner periphery, as shown in FIG. 3, is selected and the tab is bent up out of the plane of the disc as shown in the drawing. The disc is then inserted between the blade heads and the flat-bottomed trough of the razor with the abrasive surface of the disc resting flatly against the inner surface 12.3 of the trough. The tab 16.5 extends outwardly closely adjacent the inner wall 12.4 of the trough, as shown best in FIGS. 1 and 2, and comes into contact with the leading edge 14.5 of a blade head. The motor of the razor is then turned on, and the rotating blade heads causes the disc 16.1 to rotate so that the abrasive surface 16.2 of the disc slidingly contacts the inner flat surface 12.3 of the trough to sharpen and smoothen the same. After perhaps 15 seconds of sharpening action, the motor of the razor is turned off and the disc is now replaced with a disc in which the tab 16.6 arises from the outer periphery. Because the blade heads 14.3 do not extend all the way to the outer wall surface 12.5 of the flat-bottomed trough, there is room between the blade head and the side wall 12.5 for the tab 16.6. The tab bears against the outer wall surface 12.5 of the trough, and the abrasive surface 16.2 facing the trough surface 12.3 further tends to anchor the disc in place. The razor motor is again turned on for, e.g., 15 seconds. During this time the blade heads slide across the adjacent abrasive surface of the disc and become sharpened, the disc being anchored against turning in the trough by means of the tab 16.6 and the abrasive action of its surface against the trough.

The last mentioned sharpening disc is then removed and the razor is ready for use. In some instances when attempting to sharpen extremely dull razors, I have found it desirable to use a sharpening disc with a coarser abrasive surface (e.g., 320 grit) to begin with in the sharpening procedure, and then finish the sharpening with the 600 grit disc.

Figure 2:
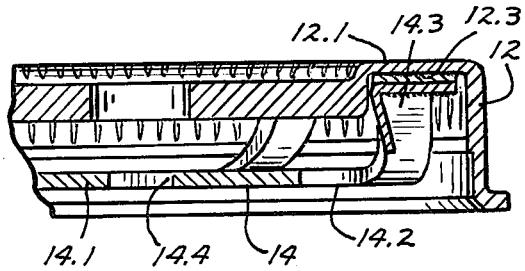
FIG. 2 is a broken away, cross-sectional view taken along line 2—2 of FIG. 1.

The tabs 16.5, 16.6 extending from the inner and outer peripheries of sharpening discs of the invention also serve as convenient handles for removing the discs from the annular trough of the comb. A tweezer or like instrument may be employed to grasp the tabs, and the flexibility of the discs permit them to be deformed and hence more easily lifted from the annular trough at the end of a sharpening operation. Although the invention has thus far been described with reference to discs having single tabs thereon, it may be desirable to provide several tabs arising from the inner or the outer periphery of the disc, thereby reducing the possibility that the blade may shear off a tab arising from the inner periphery of the disc, and also improving the stationary "seat" of the sharpening disc in the comb trough when the blade heads are to be sharpened. The flexibility of the discs of the invention not only permit their easy removal from the trough, as noted above, but also enable the discs to be readily manufactured and permit the tabs 16.5, 16.6 to be properly positioned as shown in FIGS. 2 and 6 by gentle finger pressure. Moreover, the flexible nature of the sharpening discs renders them highly resistant to breakage or other damage, and the sharpening operations many times.

While I have described a preferred embodiment of the present invention, it should be understood that various changes, adaptations, and modifications may be made therein without departing from the spirit of the invention and the scope of the appended claims.

What is claimed:

1. A sharpener for a rotary action electric razor with a comb having an annular, flat-bottomed, slotted trough and a blade having a plurality of spaced heads rotating in the trough, the sharpener comprising a flexible, normally flat annular disc receiveable in the trough flushly against its flat bottom and having a sharpening abrasive flat surface, the disc having a tab extending from an edge thereof and positionable at an angle to the plane of the disc and generally parallel to a side wall of the trough when the disc is received therein.

2. The sharpener of claim 1 in which both flat surfaces of the disc are abrasive surfaces.

3. The sharpener of claim 2 having a thickness of from about 0.15 to about 0.35 mm.

4. The sharpener according to claim 1 wherein the width of the disc measured radially across one flat surface is about 1.5 mm.

5. The sharpener according to claim 1 in which the tab extends from the inner periphery of the disc for engagement with a blade head to cause rotation of the disc with the blade for sharpening the comb.

6. The sharpener according to claim 1 wherein the tab extends from the outer periphery of the disc to lie against and generally parallel to the outer side wall of the flat-bottomed trough and out of the path of the blade heads to aid in anchoring the disc to the trough, whereby the blade heads may be sharpened.

7. The sharpener of claim 2 in which at least one of the abrasive surfaces is of about 600 grit abrasive particles and wherein the thickness of the disc is about 0.3 mm.

8. A method of sharpening a rotary action razor having a comb with an annular, flat-bottomed, slotted trough and a blade having a plurality of spaced blade heads rotating in the trough, the method comprising the separate operations of:

a. inserting between the blade heads and the trough a flexible annular disc having an abrasive, flat surface lying against the inner flat-bottomed surface of the trough and having a tab arising from its inner periphery adjacent an inner wall of the trough and in the path of rotation of a blade head, and rotating the blade in the trough whereby the disc is caused to simultaneously rotate and sharpen the comb;

b. inserting between the blade heads and the trough a flexible annular disc having an abrasive surface abutting the blade heads and having a tab arising from its outer periphery in non-obstructing relationship to the blade heads and in contact with the outer wall of the flat-bottomed trough, the disc remaining stationary in the trough, and rotating the blade heads against the abrasive surface within the trough to sharpen the blade.

* * * * *